United States Patent [19]

Taglavore

[11] 4,362,147

[45] Dec. 7, 1982

[54] ADJUSTABLE FIREPLACE PANEL

[76] Inventor: Anthony H. Taglavore, Rte. 3, 198 Sunset Dr., Gallatin, Tenn. 37066

[21] Appl. No.: 224,295

[22] Filed: Jan. 12, 1981

[51] Int. Cl.[3] ..... F24C 15/10

[52] U.S. Cl. ..... 126/140; 126/202

[58] Field of Search ..... 126/120, 121, 126, 138, 126/140, 202

[56] References Cited

U.S. PATENT DOCUMENTS

| | | | |
|---|---|---|---|
| 319,221 | 6/1885 | Gallagher | 126/138 |
| 1,863,014 | 6/1932 | Herndon | 126/202 |
| 3,789,825 | 2/1974 | Reiner | 126/140 |
| 3,888,232 | 6/1975 | Le Brun | 126/140 |
| 4,036,205 | 7/1977 | Hayes | 126/140 |

*Primary Examiner*—Ronald C. Capossela

*Attorney, Agent, or Firm*—Luedeka, Fitch & Neely

[57] ABSTRACT

The specification discloses an adjustable fireplace adapter panel (10) for covering an opening to a fireplace and for receiving a stovepipe to utilize the fireplace and the chimney thereof as an exhaust system for a stove. The panel (10) includes a main panel (16) with an aperture (18) formed therein. Plate (20) is mounted on main panel (16) covering the aperture (18) and aperture (22) is formed in the plate (20) within a perimeter defined by aperture (18). Plate (24) is mounted on plate (20) covering aperture (22) and an aperture (26) is formed in plate (24) within a perimeter defined by aperture (22) for receiving a stovepipe.

19 Claims, 8 Drawing Figures

ADJUSTABLE FIREPLACE PANEL

FIELD OF INVENTION

The present invention relates to exhaust systems for stoves and particularly relates to an adjustable fireplace adapter panel for covering a fireplace opening and receiving a stovepipe to utilize the fireplace and chimney as an exhaust system for a stove.

BACKGROUND OF THE INVENTION

Wood burning stoves have become increasingly popular in recent years, and often, wood burning stoves are used to replace fireplaces as a means of heating a residence. Most fireplaces are placed in residences for aesthetic and decorative reasons, but when a fireplace is used in conjunction with a central heating system, the fireplace may actually increase the cost of heating the home by drawing more hot air up the chimney than the fireplace produces. Energy conscious homeowners often desire to burn wood more efficiently than in the fireplace.

One solution to this problem is to utilize a wood burning stove in front of the fireplace and use the chimney as an exhaust system. In such case, a panel is placed over the opening of the fireplace, and the stovepipe discharges through the panel into the enclosed fireplace. The panel covering the fireplace opening is usually custom made since different types of stoves locate the stovepipe connection at different heights and different lateral positions. Also, fireplaces often have elevated hearths of varying heights that will vary the height of the stovepipe connection relative to the fireplace.

To accommodate the various heights of stovepipe connections, there is a need for an adjustable fireplace panel with an aperture for receiving a stovepipe that may be easily adjusted vertically and horizontally to receive stovepipes at an infinity of different positions within a preselected range. Such a panel would eliminate the expense of custom fabricating a panel for each stove and fireplace combination, speed installation of the stove since it is not necessary to delay installation while a custom panel is fabricated, and enable homeowner to install the panel himself.

SUMMARY OF INVENTION

In accordance with the present invention, there is provided an adjustable fireplace adapter panel for covering an opening to a fireplace and for receiving a stovepipe to utilize the fireplace and chimney as an exhaust system for a stove. The adapter panel includes a main panel dimensioned for covering the opening of a fireplace. The main panel is secured against the face of the fireplace in a position covering the opening thereof. A first aperture is formed in the main panel, and a first plate is dimensioned to cover the first aperture and is disposed on the main panel over the first aperture. A second aperture is formed in the first plate with the dimensions of the second aperture being smaller than those of the first aperture and with the second aperture being disposed adjacent to the main panel within the perimeter of said first aperture. A first clamp structure clamps and secures the first plate to the main panel. The first plate is movable through an infinity of positions on the main panel beneath the first clamp structure so that the second aperture may be moved to an infinity of different positions within the perimeter of the first aperture.

In accordance with a particular aspect of the present invention, the main panel and the first aperture have symmetric shapes so that each have a horizontal centerline. The first aperture is formed in the main panel with the horizontal centerline of the first aperture line being disposed off of the horizontal centerline of the main panel. In this construction, the main panel may be rotated 180° in its own plane to vary the vertical position of the first aperture and to increase the vertical range of positions of the second aperture. Similarly, the first plate and the second aperture have symmetric shapes so that each have a vertical and horizontal centerline. The second aperture may be formed in the first plate with the horizontal centerline and/or the vertical centerline of the second aperture disposed off of the horizontal and/or vertical centerlines, respectively, of the first plate. In this construction, the first plate may be rotated 180° to vary the vertical and/or horizontal position of the second aperture.

The clamp structure of the fireplace adapter panel is at least one elongate arched strip having one longitudinal edge engaging the rear side of the main panel, having a second longitudinal edge engaging the first plate and having a midsection spaced apart from the first plate and main panel. The midsection of the arched strip is fastened to and urged toward the main panel to clamp the first plate against the main panel.

In accordance with another particular aspect of the present invention, the fireplace adapter panel includes a second plate dimensioned to cover the second aperture of the first plate and is disposed on the first plate positioned over the second aperture. A third aperture is formed in the second plate with dimensions smaller than those of the second aperture and is disposed within the perimeter of the second aperture. Second clamp structure clamps and secures the second plate to the first plate, and the second plate is movable through an infinity of positions on the first plate beneath the second clamp structure so that the third aperture may be moved to an infinity of different positions withi the perimeter of the second aperture.

The second plate and third aperture may have symmetric shapes so that each have horizontal and vertical centerlines. The third aperture may be formed in the second plate with the horizontal centerline and/or the vertical centerline of the third aperture disposed off of the horizontal and/or vertical centerline of the second plate. In this construction, the second plate may be rotated 180° to vary the vertical and/or horizontal position of the third aperture.

In accordance with another particular aspect of the present invention, the second clamp structure is substantially identical to the first clamp structure and includes a first elongate arched strip having one longitudinal edge engaging the first plate, having a second longitudinal edge engaging the second plate, and having a midsection spaced apart from the first and second plates. The midsection of the arched strip is fastened to and urged toward the first plate to secure the second plate thereon.

BRIEF DESCRIPTION OF THE DRAWINGS

The present invention may best be understood by reference to the Detailed Description when considered in conjunction with the accompanying Drawings in which.

DETAILED DESCRIPTION

Figure 1:
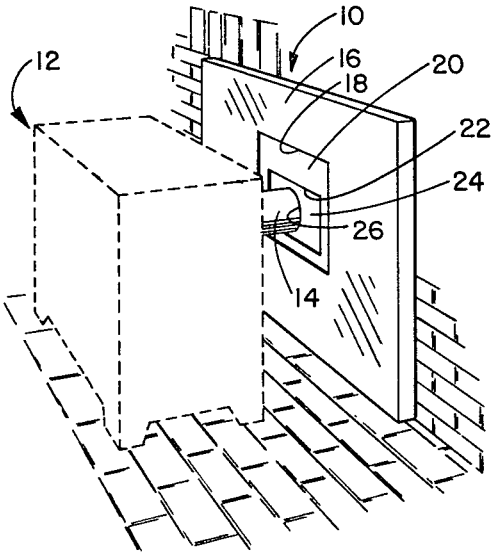
FIG. 1 is a front view of an adjustable fireplace adapter panel embodying the present invention shown mounted over a fireplace opening with a stove shown in phantom lines positioned in front of the adapter panel.

Referring now to the Drawings in which like reference characters designate like or corresponding parts throughout the several views, there is shown in FIG. 1, a perspective front view of an adjustable fireplace adapter panel 10 embodying the present invention. A stove 12 is shown in phantom lines positioned in front of the fireplace adapter panel 10, with a stovepipe 14 extending from the stove 12 through the adapter panel 10 and into the fireplace behind the adapter panel 10. In this manner, smoke from the stove 12 is exhausted through the adapter panel 10 into the fireplace and up the fireplace chimney. It will be appreciated that heat is also exhausted, to some extent, through the stovepipe 14 and the hot air in the fireplace naturally rises causing a normal draft. Thus, any air leaks in the adapter panel 10 will normally leak air into the fireplace while the stove 12 is operating.

The fireplace adapter panel 10 includes a main panel 16 that is disposed flush against the face of the fireplace covering the fireplace opening. A rectangular aperture 18 is cut in the main panel 16, and plate 20 is mounted on the rear side of the main panel 16 covering the aperture 18. A rectangular aperture 22 is cut in the first plate 20 and by moving the plate 20 up or down, the aperture 22 may be positioned at an infinity of different positions within the perimeter of aperture 18.

A second plate 24 is mounted on the rear side of the first plate 20 covering the aperture 22. The second plate has a circular aperture 26 for receiving the stovepipe 14. By moving the plate 24 horizontally, the aperture 26 may be moved to an infinity of different positions within the perimeter of the aperture 22. Thus, it will be appreciated that the vertical position of aperture 26 may be adjusted by vertically moving the plate 20, and the horizontal position of aperture 26 may be horizontally adjusted by moving plate 24 in a horizontal direction. In this manner, the aperture 26 may be moved to an infinity of different positions within the perimeter of aperture 18.

Figure 2:
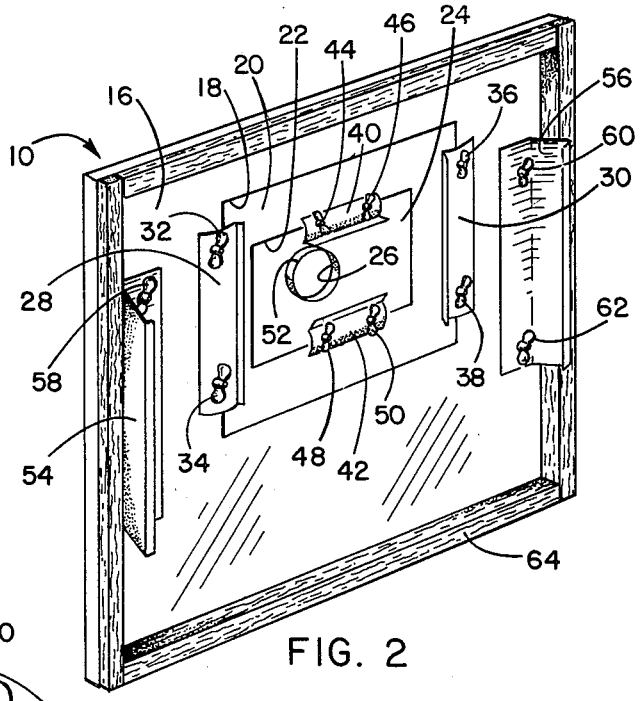
FIG. 2 is a rear view of the adjustable fireplace adapter panel shown in FIG. 1.

The rear side of the main panel 16 is shown in FIG. 2 to illustrate the structure that secures plates 20 and 24 to the main panel 16 and the structure that secures the main panel 16 to the fireplace opening. The plate 20 is secured to the rear side of the main panel 16 by substantially vertical spaced apart parallel clamps 28 and 30. Clamp 28 is secured to the main panel 16 by wing nuts 32 and 34 that are threadedly secured on studs extending from the rear side of the main panel 16. Likewise, clamp 30 is secured to the main panel 16 by wing nuts 36 and 38 that are threadedly secured on studs extending from the main panel. In this construction, plate 20 may be moved in a vertical direction by loosening the wing nuts 32, 34, 36, and 38, sliding the plate 20 upwardly or downwardly, and retightening the wing nuts. The plate 20 is dimensioned substantially greater than aperture 18 in both length and width so that vertical movement of the plate 20 within a preselected range will not uncover the aperture 18.

Plate 24 is secured to the rear side of plate 20 by substantially horizontal spaced apart parallel clamps 40 and 42. Clamp 40 is secured to the rear side of plate 20 by wing nuts 44 and 46 that are threadedly secured to threaded studs or bolts extending through and/or extending from the rear side of plate 20. Clamp 42 is likewise secured to the rear side of plate 20 by wing nuts 48 and 50 or other fasteners. In this construction, the plate 24 may be moved horizontally by loosening the wing nuts 44, 46, 48, and 50, sliding the plate 24 horizontally and retightening the wing nuts. The plate 24 is dimensioned greater than the aperture 22 so that horizontal movement of the plate 24 within a preselected range will not uncover the aperture 22. Plate 24 is also dimensioned with a sufficiently small width so that it may pass between studs and wing nuts 32 and 34 (and 36 and 38) and under clamps 28 and 30. By using the clamping system described above, the plates 24 and 20 may be placed in an infinity of different positions with the aperture 26 remaining within a perimeter defined by the aperture 18 shown in FIG. 1 formed in the main panel 16. A flu collar 52 is fastened to the rear side of plate 24 about the aperture 26 for receiving the stovepipe. In this manner, a better seal and better support is achieved between the plate 24 and the stovepipe 14.

The main panel 16 is secured to the fireplace by elongate metal strips 54 and 56 that are secured to the rear of the main panel 16 by wing nuts, such as wing nuts 58, 60, and 62 shown in FIG. 2, that are threadedly secured on studs extending from the rear of the main panel 16. The elongate metal strips 54 and 56 extend into the fireplace opening and engage the interior thereof to grip or clamp against the fireplace and secure the panel in proper position flush against the face of the fireplace.

A seal 64 is fastened along the rear perimeter of the main panel and is constructed of a material substantially impervious to air and resistant to heat, such as fiberglass. The seal 64 engages and conforms to the face of the fireplace to form a seal between the main panel 16 and a fireplace. By using seal 64, the panel 16 need not be exactly dimensioned to fit a fireplace opening, so long as the panel 16 is larger than the opening.

Referring to FIGS. 1 and 2, it is shown that the aperture 18 is disposed off of the horizontal center of the main panel 16. In FIGS. 1 and 2 the aperture 18 is nearer the top of main panel 16, but by rotating the main panel 180° in its own plane, the aperture 18 may be positioned nearer the bottom of the main panel. By locating the aperture 18 off center, the vertical range of positions that aperture 26 may assume is increased by the rotation of the main panel 16.

Figure 3:
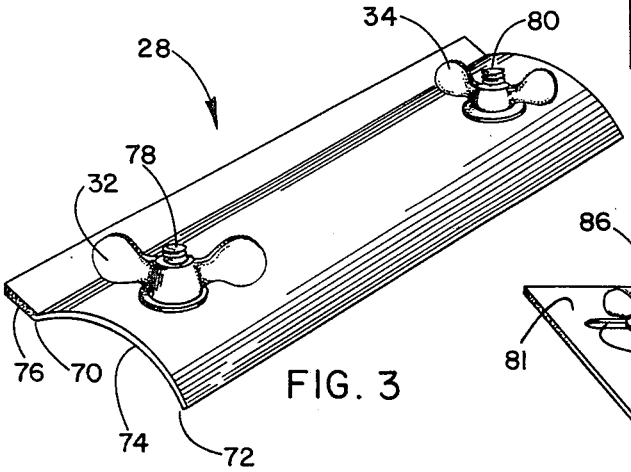
FIG. 3 is a detailed view of a clamp of the present invention used to secure plates to the fireplace adapter panel.

Referring now to FIG. 3, there is shown a detailed perspective view of clamp 28, and it will be understood that clamp 30 and clamps 40 and 42 are substantially similar in construction to clamp 28. Clamp 28 includes a longitudinal edge 70 for engaging the plate 20 (shown in FIG. 2) and a second longitudinal edge 72 for engaging the rear side of main panel 16 (shown in FIG. 2). The midsection 74 of the clamp 78 is arched so that the midsection 74 will be spaced apart from the plate 20 and the main panel 16. A pair of stus 78 and 80 extend from the rear side of the main panel 16 through apertures in the clamp 28, and wing nuts 32 and 34 screw down on the studs 78 and 80 securing the clamp 28 to and urging the clamp 28 toward the rear side of the main panel 16. The clamp 28 also includes a lip 76 extending upwardly from the longitudinal edge 70. The lip 76 aids in sliding the plate 20 under the clamp 28 during initial construction of the fireplace adapter panel 10.

Figure 4:
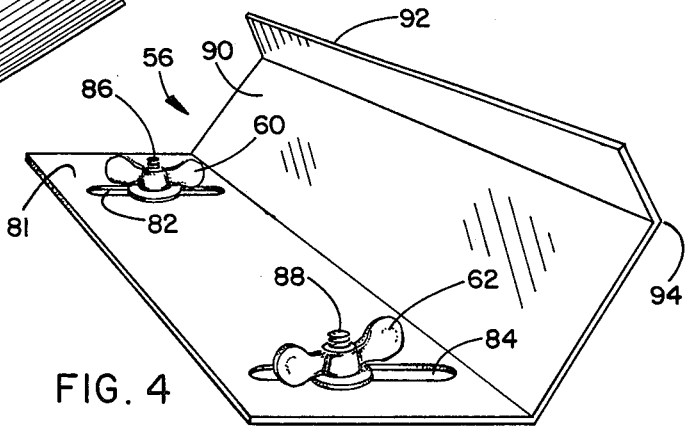
FIG. 4 is a detailed view of an elongate metal strip used to engage the interior of the fireplace and to secure the fireplace adapter panel to the face of the fireplace.

The clamps 40 and 42 are substantially similar to the clamp 28 except that the studs 78 and 80 extend from the rear side of plate 20 (shown in FIG. 2), instead of the main panel 16. Also, the longitudinal edge 70 engages plate 24 and the longitudinal edge 72 engages plate 20. Referring now to FIG. 4, there is shown a detailed view of the elongate metal strip 56 which is identical to the elongate metal strip 54. The strip 56 includes a elongate base 80 that is normally secured to the rear side of the main panel 16 as shown in FIG. 2. A pair of parallel spaced apart slots 82 and 84 are formed in the base 80 in an orientation substantially perpendicular to the base 80. Studs 86 and 88 extend from the rear of the main panel 16 through the slots 82 and 84, respectively, and wing nuts 60 and 62 are threadedly secured on the studs 86 and 88, respectively, to fasten the base 80 to the main panel 16.

An elastically flexible flange 90 extends upwardly from the base 80 and, as shown in FIG. 2, is inclined away from the center of the main panel 16. From the top of the flange 90, a lip 92 extends back towards the center of the main panel 16. The longitudinal edge 94 is formed at the intersection of the flange 90 and the lip 92 and normally engages the interior of the fireplace. The lip 92 facilitates the insertion of the flange 90 within the fireplace opening. As the flange 90 is forced toward the fireplace, the lip 92 first engages the fireplace opening and by virtue of its inclination urges the flange 90 inwardly to properly position the flange 90 within the fireplace opening is a tensioned condition. It will be appreciated that the position of the strip 56 may be adjusted by loosening the wing nuts 60 and 62, sliding the base 80 in a direction parallel to the slots 82 and 84 and retightening the wing nuts. In this manner, the position of the strip 56 may be adjusted to accommodate varying sizes of fireplace openings.

Figure 5:
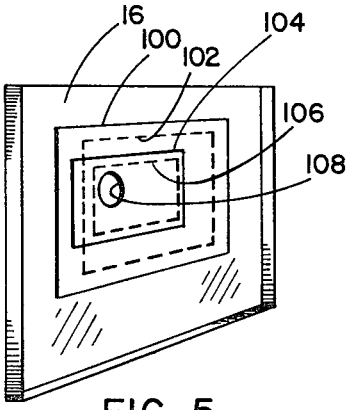
FIG. 5 is a somewhat diagrammatical rear view of another adjustable fireplace adapter panel showing off center apertures in the main panel and in two plates of the fireplace adapter panel.

Referring now to FIG. 5, there is shown a somewhat diagrammatical view of the rear side of panel 16 to illustrate another embodiment of the invention. In this embodiment a plate 100 is mounted on the rear side of the main panel 16 using clamps as shown in FIG. 2, but for purposes of clarity of illustration, the clamps are not shown in FIG. 5. Likewise, a plate 104 is mounted on plate 100 using clamps similar to clamps 40 and 42 shown in FIG. 2, but these clamps have not been shown in FIG. 5.

The main panel 16 has an aperture 102 formed therein. The aperture 102 is symmetrical in shape and has a horizontal centerline disposed above the horizontal centerline of the main panel 16. Plate 102 has a rectangular shape and has a rectangular aperture 106 formed therein. The horizontal centerline of the aperture 106 is disposed above the horizontal centerline of the plate 102, and the vertical centerline of aperture 106 is disposed to the left of the vertical centerline of plate 102. Plate 104 has a circular aperture 108 formed therein with the horizontal and vertical centerlines of the aperture 108 being disposed off of the horizontal and vertical centerlines of plate 104.

Figure 6:
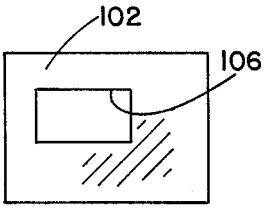
FIG. 6 is a detailed view of a first plate as shown in FIG. 5 mounted on the main panel of the fireplace adapter panel.
Figure 7:
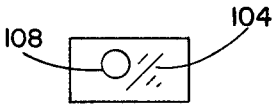
FIG. 7 is a detailed view of a second plate shown in FIG. 5 mounted on the first plate.

In FIG. 5, apertures 106 and 102 are shown in phantom lines since they are hidden from view by plates 104 and 102. In FIGS. 6 and 7, plates 102 and 104 are shown separately. Referring now to FIGS. 5, 6, and 7, it may be appreciated that the horizontal and vertical position of aperture 108 may be varied by a 180° rotation of the plate 104 in its own plane. The aperture 108 is, thus, moved from the upper left quadrant of plate 104 to the lower right quadrant thereof. By rotating the plate 104 horizontally in a plane perpendicular to the plane of the plate 104, the horizontal position of the aperture 108 is changed, but the vertical position remains unchanged. By rotating the plate 104 vertically in a plane perpendicular to the plate 104, the vertical position of aperture 108 may be changed vertically without changing the horizontal position of the aperture 108.

When two plates, such as plates 102 and 104 are mounted on main panel 16, the plate mounted on the main panel, plate 102 in the preferred embodiment, would only be rotated in its own plane to change the position of its aperture, such as aperture 16. Thus, normally aperture 106 would be formed in plate 102 in a position off of the vertical centerline of plate 102 or off of the horizontal centerline of plate 102, but not both. However, to illustrate both concepts, aperture 106 is formed in plate 102 with its horizontal and vertical centerlines disposed off of the horizontal and vertical centerlines, respectively, of plate 102. Thus, when plate 102 is rotated 180° in its own plane, the aperture 106 is repositioned horizontally and vertically.

The location of apertures in positions off of the center of a plate results in increased ranges in which the aperture may be positioned. For example, referring to FIG. 5, plate 104 could not be moved horizontally to place aperture 108 on the far right side of aperture 106 without uncovering aperture 106. However, by rotating the plate, aperture 108 may be so positioned. This same increased range could not be achieved by simply lengthening plate 104 because the length of plate 104 would interfere with or engage the clamps (not shown) holding plate 100 when it was attempted to place the aperture 108 in the position shown in FIG. 5.

Figure 8:
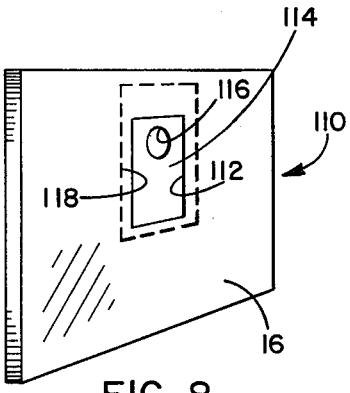
FIG. 8 is a somewhat diagrammatical view of an adjustable fireplace adapter panel that is adjustable only in a vertical direction.

Referring now to FIG. 8, an adjustable fireplace adapter panel 110 is shown diagrammatically in front view and constitutes another embodiment of the present invention. A rectangular aperture 112 is cut in the main panel of 110, and a plate 114 is mounted on the rear side of the main panel 16 covering the aperture 112. The plate 116 has a circular aperture 116 formed therein, and is movable through an infinity of positions within a perimeter defined by the aperture 112. The perimeter of the plate 114 is disposed on the rear side of the main panel 116 and is shown in phantom lines 118 because it is hidden from view. By reference to the hidden lines 118, it will be appreciated that aperture 116 is cut in plate 114 in a position off of the horizontal centerline of the plate 114. To move the aperture 116 from the uppermost position shown in FIG. 8 to the lowermost possible position within the perimeter defined by aperture 112, the plate 114 must be rotated 180°. Aperture 116 cannot be moved to its lowermost position within the aperture 112 by merely sliding the plate 114 downward because the upper edge of the plate 112 would drop below the upper edge of the aperture 114 and, thus, uncover the aperture 112. By using a plate, such as plate 114 with an aperture, such as aperture 116, disposed off of the horizontal centerline of the plate, the vertical range of positions of the aperture 116 is increased.

While particular embodiments have been described in the foregoing Detailed Description, it will be appreciated that the invention is capable of numerous rearrangements, substitutions, or modifications of parts without departing from the spirit of the invention.

I claim:

1. An adjustable fireplace adapter panel for covering an opening to a fireplace and for receiving a stovepipe to utilize the fireplace and chimney as an exhaust system for a stove, comprising:

a main panel dimensioned for covering the opening of the fireplace;

means for securing said main panel against the face of the fireplace in a position covering the opening thereof;

a first aperture formed in said main panel;

a first plate dimensioned to cover said first aperture and disposed on said main panel over said first aperture;

a second aperture formed in said first plate, having dimensions smaller than said first aperture and being disposed within the perimeter of said first aperture;

first clamp means for clamping and securing said first plate to said main panel; and said first plate being movable through an infinity of positions on said main panel beneath said first clamp means so that said second aperture may be moved to an infinity of different positions within the perimeter of said first aperture.

2. The fireplace adapter panel of claim 1 wherein said second aperture is adapted to snugly receive the stovepipe.

3. The fireplace adapter panel of claim 1 wherein said main panel and said first aperture have symmetric shapes and horizontal centerlines, said first aperture being formed in said main panel with the horizontal centerline of said first aperture being disposed off of the horizontal centerline of said main panel so that said main panel may be rotated 180° in its own plane to vary the vertical position of said first aperture and to increase the vertical range of positions of said second aperture.

4. The fireplace adapter panel of claim 1 wherein said first plate and second aperture have symmetric shapes so that said first plate and said second aperture each have a horizontal centerline, said second aperture being formed in said first plate with the horizontal centerline of said second aperture being disposed off of the horizontal centerline of said first plate so that said first plate may be rotated 180° in its own plane to vary the vertical position of said second aperture.

5. The fireplace adapter panel of claim 1 wherein said first plate and said second aperture have symmetric shapes so that said first plate and said second aperture each have a vertical centerline, said second aperture being formed in said first plate with the vertical centerline of said second aperture being disposed off of the vertical centerline of said first plate so that first plate may be rotated 180° to vary the horizontal position of said second aperture.

6. The fireplace adapter panel of claim 1 wherein said first plate and said second aperture each have horizontal and vertical centerlines extending through a geometric center point of said first plate and said second aperture, respectively, said second aperture being formed in said first plate with the vertical and horizontal centerlines of said second aperture being disposed off of the vertical and horizontal centerlines, respectively, of said first plate, so that said first plate may be rotated 180° in its own plane and may be rotated 180° in a direction perpendicular to its own plane to vary the vertical and horizontal position of said second aperture.

7. The fireplace adapter panel of claim 1 wherein said first plate is adjustable in a vertical direction to vary the vertical position of said second aperture.

8. The fireplace adapter panel of claim 1 wherein said means for securing comprises at least one elongate metal strip mounted adjacent to a side of said main panel for securing said main panel adjacent to the face of a fireplace, said elongated metal strip having an elongate base mounted flush on the rear of said main panel to increase the rigidity of said main panel and having a clamping flange extending from said base in a direction away from the center of said main panel, said clamping flange being elastically flexible for engaging the interior of said fireplace to secure said main panel over the fireplace opening.

9. The fireplace adapter panel of claim 8 further comprising:

at least one slot formed in said base of said elongate metal strip in an orientation generally perpendicular to said base;

at least one threaded stud mounted on the rear said main panel in a position to fit within said slot; and at least one threaded nut for being threaded on said stud to selectively secure said base of said elongate metal strip to the rear of said main panel, the position of said elongate metal strip being adjustable in a direction parallel to said slot.

10. The fireplace adapter panel of claim 1 wherein said first clamp means comprises:

an elongate arched strip having one longitudinal edge engaging the rear side of said main panel, having a second longitudinal edge engaging said first plate, and having a midsection spaced apart from said first plate and said main panel; and means for fastening the midsection of said arched strip to said main panel and for urging the midsection toward said main panel.

11. The fireplace adapter panel of claim 10 wherein said means for fastening comprises:

at least one threaded stud extending from the rear of said main panel;

an aperture in the midsection of said arched strip dimensioned to receive said threaded stud; and a threaded nut for being threadedly secured on said stud to urge the midsection of said arched strip towards said main panel to clamp said first plate to the rear of said main panel.

12. The fireplace adapter panel of claim 1 wherein said first clamp means comprises:

a pair of elongate arched strips having one longitudinal edge engaging the rear side of said main panel, having a second longitudinal edge engaging said first plate, and having a midsection spaced apart from said first plate and said main panel, said pair of arched strips being vertically disposed adjacent to the vertical sides of said first plate so that said first plate is movable in a vertical direction beneath said clamp means; and means for fastening the midsections of the pair of said arched strips to said main panel and for urging the midsections of said arched strips towards said main panel to clamp said first plate to the rear of said main panel.

13. The fireplace adapter panel of claim 1 further comprising:

a second plate dimensioned to cover said second aperture and disposed on said first plate positioned over said second aperture;

a third aperture formed in said second plate, having dimensions smaller than said second aperture and being disposed within the perimeter of said second aperture;

second clamp means for clamping and securing said second plate to said first plate; and said second plate being movable through an infinity of positions on said first plate beneath said second clamp means so that said third aperture may be moved to an infinity of different positions within the perimeter of said second aperture.

14. The fireplace adapter panel of claim 13 wherein:

said first clamp means and said first plate are adapted to allow linear position adjustment of said first plate in a first direction parallel to the plane of said main panel; and said second clamp means and said second plate are adapted to provide linear adjustment of said second plate in a second direction parallel to the plane of said main panel and perpendicular to said first direction so that by adjusting said first plate in the first direction and adjusting said second plate in the second direction said third aperture may be positioned at any desired position within a preselected planar boundary.

15. The fireplace adapter panel of claim 13 wherein said second plate and said third aperture have symmetric shapes so that said second plate and third aperture each have a horizontal centerline, said third aperture being formed in said second plate with the horizontal centerline of said third aperture disposed off of the horizontal centerline of said second plate so that said second plate may be rotated in its own plane 180° to vary the vertical position and the vertical range of positions of said third aperture.

16. The fireplace adapter panel of claim 13 wherein said second plate and said third aperture have symmetric shapes so that said second plate and said third aperture each have a vertical centerline, said third aperture being formed in said second plate with the vertical centerline of said third aperture disposed off of the vertical centerline of said second plate so that said second plate may be rotated 180° in its own plane to vary the horizontal position of said third aperture.

17. The adjustable fireplace adapter panel of claim 13 wherein said second plate and said third aperture have symmetric shapes so that said second plate and said third aperture each have horizontal and vertical centerlines extending through a geometric center point of said second plate and said third aperture, respectively, said third aperture being formed in said second plate with the vertical and horizontal centerlines of said third aperture disposed off of the vertical and horizontal centerlines, respectively, of said second plate so that said second plate may be rotated 180° in its own plane and may be rotated 180° in a direction perpendicular to its own plane to vary the horizontal and vertical positions and ranges of positions of said third aperture.

18. The fireplace adapter panel of claim 13 wherein said first and second clamp means comprise:

at least one first elongate arched strip having one longitudinal edge engaging the rear side of said main panel, having a second longitudinal edge engaging said first plate, and having a midsection spaced apart from said main panel and said first plate;

means for fastening the midsection of said first arched strip to said main panel and for urging the midsection of said first arched strip toward said main panel;

at least one second elongate arched strip having one longitudinal edge engaging said first plate, having a second longitudinal edge engaging said second plate, and having a midsection spaced apart from said first and second plates; and means for fastening the midsection of said second arched strip to said first plate and for urging the midsection of said second arched strip toward said first plate.

19. The fireplace adapter panel of claim 13 wherein said first and second clamp means comprise:

a pair of first elongate arched strips, each of said first arched strips having one longitudinal edge engaging the rear side of main panel, having a second longitudinal edge engaging said first plate, and having a midsection spaced apart from said main panel and said first plate, said pair of first longitudinal strips being disposed in a spaced apart parallel relationship oriented in a first direction parallel to the plane of said main panel;

means for fastening the midsections of said first arched strips to said main panel and for selectively urging the midsections of said first arched strips toward said main panel;

a pair of second elongate arched strips, each of said second arched strips having one longitudinal edge engaging said first plate, having a second longitudinal edge engaging said second plate, and having a midsection spaced apart from said first and second plates, said second arched strips being disposed in a spaced apart parallel relationship and being oriented in a direction parallel to the plane of said main panel and perpendicular to the direction of said first arched strips; and means for fastening the midsections of said second arched strips to said first plate and for selectively urging the midsections of said second arched strips toward said first plate.

* * * * *